US008074955B2

(12) United States Patent
Kumar et al.

(10) Patent No.: US 8,074,955 B2
(45) Date of Patent: Dec. 13, 2011

(54) METHOD AND APPARATUS FOR IMPROVING THE STRENGTH OF A UTILITY POLE

(75) Inventors: Pramod Kumar, New Delhi (IN); Saresh Nagesh, Bangalore (IN)

(73) Assignee: Cooper Technologies Company, Houston, TX (US)

( * ) Notice: Subject to any disclaimer, the term of this patent is extended or adjusted under 35 U.S.C. 154(b) by 68 days.

(21) Appl. No.: 12/168,312

(22) Filed: Jul. 7, 2008

(65) Prior Publication Data

US 2010/0001166 A1 Jan. 7, 2010

(51) Int. Cl.
*F16M 13/00* (2006.01)

(52) U.S. Cl. ... 248/519; 248/534; 248/511; 248/346.01; 52/296; 52/848

(58) Field of Classification Search ..... 248/519, 248/511, 539, 534, 346.01, 523, 535; 52/296, 52/726, 98, 720.1; 174/66, 45 R
See application file for complete search history.

(56) References Cited

U.S. PATENT DOCUMENTS

| | | | | |
|---|---|---|---|---|
| 3,755,977 | A * | 9/1973 | Lewis | 52/98 |
| 4,914,258 | A * | 4/1990 | Jackson | 174/45 R |
| 5,481,846 | A | 1/1996 | Macchietto | |
| 6,303,863 | B1 * | 10/2001 | Raasch | 174/66 |
| 6,327,833 | B1 * | 12/2001 | Miskelley et al. | 52/848 |
| 7,694,476 | B2 * | 4/2010 | Cook et al. | 52/296 |
| 2004/0139812 | A1 * | 7/2004 | Erel et al. | 74/89.23 |

* cited by examiner

*Primary Examiner* — Terrell Mckinnon
*Assistant Examiner* — Todd M. Epps
(74) *Attorney, Agent, or Firm* — King & Spalding LLP

(57) ABSTRACT

A support pole with enhanced strength along it's base includes an elongated pole member secured to a mounting plate. A majority of the length of the pole member has a uniform cross-section. Slits are cut into each side of the pole member along its lower end. A mandrel is placed into the lower end of the pole and expanded, thereby expanding the lower end of the pole away from the center and creating a larger cross-sectional area at its lower end. The lower end of the pole is secured to the mounting plate. Reinforcing members are welded over the expanded slits and the bottom of the reinforcing member is further welded to the mounting plate. The lower section with a larger cross-sectional area increases the moment of inertia and surface area of the support pole, thereby increasing the strength of the support pole.

16 Claims, 4 Drawing Sheets

METHOD AND APPARATUS FOR IMPROVING THE STRENGTH OF A UTILITY POLE

FIELD OF THE INVENTION

The present application relates generally to support poles used for utility applications. Specifically, the present invention relates to support poles modified by expanding the base of the pole to increase the strength of the pole.

BACKGROUND OF THE INVENTION

Support poles are common structures used for a variety of functions, including supporting lamps, holding power lines, antennas, and mounting devices that require a raised vantage point. Support poles are often made with a uniform cross sectional area to a standardized set of dimensions in order to utilize other standardized components. Maintaining adherence to industry standards is necessary in order that replacement poles fit preexisting installations. Typically, a support pole includes an elongated pole which is secured to a mounting plate that anchored in position. Common methods for securing support poles include welding the support pole to the mounting plate.

A problem with conventional support poles involves stress concentrations that occur near the interface between the support pole and the mounting plate. When external factors, such as wind, act on the support pole, they generate forces that act to introduce stresses causing structural faults at the base of the support pole that are propagated throughout the connection to the mounting plate. These stresses decrease the operational life of the pole.

Therefore, a need exists for a support pole with increased strength that fits within industry standards while increasing the operational life of the support pole.

SUMMARY OF THE INVENTION

The present invention relates generally to a support pole redesign that helps reduce stress concentrations and increases the operational life of the support pole. This is facilitated by a greater surface area in contact with the mounting plate due to expansion of the lower end of the support pole, which results in spreading more load to the foundation as described below.

For one aspect of the present invention, the support pole can include an elongated pole member. The elongated pole member generally includes an upper end, a lower end, and a plurality of sides. One or more slits can be cut into one or more of the sides of the pole member. The slits can extend from the lower end of the pole member up to a predetermined distance. The predetermined distance can be based on the amount of the lower end of the pole member that a manufacturer wishes to expand outward, or angularly displace, from each side along the remaining length of the pole member. A reinforcing member can be placed over the slit and coupled to a side of the pole member so that the slit is not visible from the exterior of the pole member.

For another aspect of the present invention, a system for increasing the strength of a support pole can include an elongated pole member that includes an upper and lower end and a plurality of sides disposed about the length of the pole member. A reinforcing device can include a first aperture, a second aperture, and side walls positioned between the first and second apertures. The apertures can be dimensioned so that the lower end of the pole member can be slidably inserted through the first aperture and positioned adjacent to the second aperture. Further, the perimeter of the first aperture can be less than the perimeter of the second aperture. The reinforcing device can be coupled to the pole member along the ends of the side walls adjacent the first aperture and both the pole member and the ends of the side walls positioned adjacent the second aperture can be coupled to a mounting plate.

For yet another aspect of the present invention, a method for improving the strength of the support pole can include the step of providing a support pole that includes an upper end, a lower end, and a plurality of side walls disposed between the two ends. A slit can be cut into each side wall. The slit can be a predetermined length and can extend from the lower end of the support pole toward the upper end. An expansion device can be placed inside the support pole near the lower end and can angularly displace the side walls outward. Reinforcing members can be coupled to each side wall. The reinforcing members can typically cover the slit made in its respective side wall and extend from the bottom of the pole member to a point adjacent to where angular displacement of the side wall is initiated. The lower end of the pole member can then be coupled to a mounting plate.

These and other aspects, objects, and embodiments of the present invention will become apparent to those having ordinary skill in the are upon consideration of the following detailed description of illustrative embodiments exemplifying the best mode for carrying out the invention as presently perceived.

BRIEF DESCRIPTION OF THE DRAWINGS

For a complete understanding of the present invention and the advantages thereof, reference is now made to the following description in conjunction with accompanying figures in which.

The appended drawings illustrate only exemplary embodiments of this invention and are therefore not to be considered limiting of its scope, as the invention may admit to other equally effective embodiments.

DETAILED DESCRIPTION OF THE EXEMPLARY EMBODIMENTS

The present invention provides a reinforced support pole with increased strength along its base. The reinforced support pole is created by modifying a basic support pole and coupling reinforcing members in such a manner that the strength of the reinforced support pole along the base is increased. Exemplary embodiments of the present invention can be more readily understood by reference to the accompanying figures.

It should be understood at the outset that although exemplary embodiments of the invention are illustrated below, the present invention may be practiced using any number of techniques, whether currently known or in existence. The present invention should in no way be limited to the exemplary implementations, drawings, and techniques illustrated below, including the exemplary design and implementation illustrated and described herein.

Any spatial references herein such as, for example, "top," "bottom," "upper," "lower," "above," "below," "rear," "between," "vertical," "angular," "beneath," etc., are for the purpose of illustration only and do not limit the specific orientation or location of the described structure.

Figures 1, 2A, 3A, 3B:
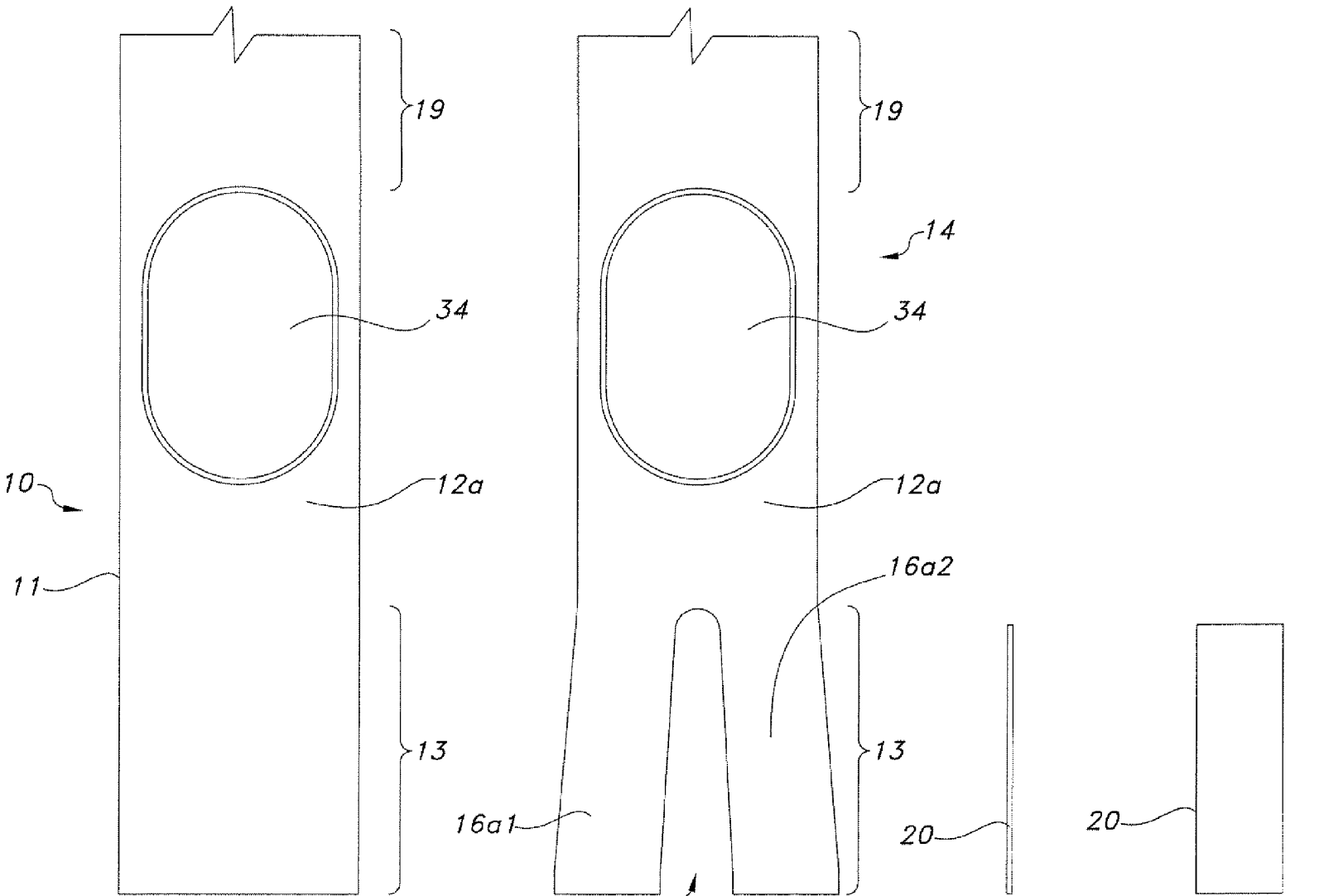
FIG. 1 is a partial elevation view of a basic support pole according to one exemplary embodiment of the present invention.
FIG. 2*a* is a partial elevation view a support pole with portions removed from the base of the support pole according to one exemplary embodiment of the present invention.
FIG. 3*a* is a side elevation view of a reinforcing member according to one exemplary embodiment of the present invention.
FIG. 3*b* is a side elevation view of the reinforcing member of FIG. 3*a* according to one exemplary embodiment of the present invention.

Referring now to the figures, in which like numerals represent like elements throughout the figures, aspects of the figures will be described. FIG. 1 is a partial elevation view of a basic support pole according to one exemplary embodiment of the present invention. Referring now to FIG. 1, the basic support pole 10 includes an elongated pole member 11 with an upper end 19 and a lower end 13. In one exemplary embodiment, the basic support pole 10 has a square cross-section, as shown in FIG. 1, with faces 12*a*, 12*b* (not shown), 12*c* (not shown), and 12*d* (not shown). It will be understood that a basic support pole 10 with any geometric cross-section may be used without departing from the scope and spirit of the present invention. In one exemplary embodiment, the basic support pole 10 is made from a single piece of material, such as steel, and has a uniform thickness. In the exemplary embodiment shown, the thickness of the material used to form the basic utility pole is 0.120 inches. In certain exemplary embodiments, 0.120 inches is the minimum thickness of the material used to form the utility pole, however, materials having a greater or lesser thickness can be used based on the type of material and the application for which the pole will be used.

FIG. 2*a* is a partial elevation view a support pole with portions removed from the base of the support pole 14 according to one exemplary embodiment of the present invention. Now referring to FIG. 2*a*, the support pole 14 includes one or more slits 15*a* made in the lower end 13 of the basic support pole 10. The slit 15*a* is made by removing portions of the material from the lower end 13 of one or more sides of the basic support pole 10. In one exemplary embodiment, each slit 15 includes a rectangular portion extending up from the base of the lower end and a semicircular portion extending up from the top of the rectangular portion. The width of the slit 15 varies based on the particular application the support pole 14 is used in.

In one exemplary embodiment, the width of the slit 15 prior to expansion varies from 0.09 inches to substantially the width of that side of the pole 14. Thus, for example, a pole 14 having a square cross-section and a dimension of about six inches along each side prior to expansion, the slit 15 could be as much as 5.5 inches wide or more along each side. In alternative embodiments where the dimensions of the sides of the pole 14 are different, the slit 15 can have a width that is substantially be anywhere between 0.09 inches and substantially the entire width of the side of the pole. In addition, the slit can have a width along the bottom that is greater than along the top or a width along the top that is greater than along the bottom. In each of these embodiments, the width of the slit 15 can gradually and uniformly expand or decrease from the top portion of the slit 15 to the bottom portion of the slit 15. In an alternative embodiment, the increase or decrease of the width of the slit 15 can be non-uniform. In one exemplary embodiment, additional slits 15*b-d* (not shown) are made along each corresponding side 12*b-d* around the perimeter of the support pole 14.

The height that the slit 15 extends into the support pole 14 is based on several factors, including, but not limited to position of the hand hole 34, aesthetics, costs, and benefits associated with slit height. In one exemplary embodiment, the slit height is between five and six inches. However slits between one and five inches could also be used. In alternative embodiments, the slits 15 may be of any height based on the experience of those skilled in the art. Once the slits 15 have been cut into the support pole 14, a mandrel (not shown) is positioned within the lower end 13 of the support pole 14 and the lower end 13 is expanded outward, or flared, to give the base of the support pole 14 a greater cross-sectional area than the portion of the support pole 14 above the lower end 13. In one exemplary embodiment the point along the support pole 14 where expansion begins is along the top of the slit 15. In alternative embodiments, the point along the support pole 14 where expansion beings is above or below the top of the slit 15.

Figure 2B:
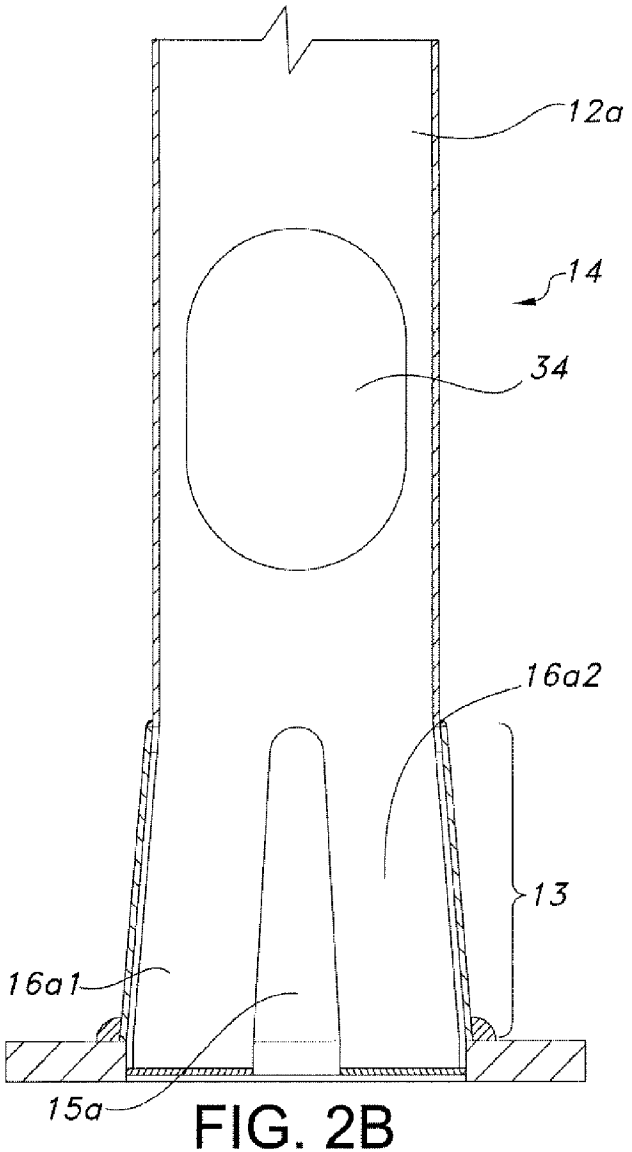
FIG. 2*b* is a partial elevation view of the support pole of FIG. 2*a* of the present invention with a portion of the base of the pole expanded to create a flared base according to one exemplary embodiment.

FIG. 2*b* is a partial elevation view of the support pole of FIG. 2*a* of the present invention with a portion of the base of the support pole 14 expanded to create a flared base according to one exemplary embodiment. The flared out portions 16 of the lower end 13 of the support pole 14 are designated 16*a*1 and 16*a*2. In this exemplary embodiment, each face 12 of the support pole 14 has a flared out portion 16 which is substantially similar to the previously disclosed flared out portions 16*a*1 and 16*a*2 for each side, designated 16*b*1-16*d*2, covering slits 15 on each face 12*b-d* of the exemplary embodiment, designated 15*b-d*. As shown in FIG. 2*b*, the lower end 13 is wider than the remainder of the support pole 14 as the flared portions 16*a*1-*d*2 are separated, widening the expanded slits 15*a-d*. As a result of the flaring in the lower end 13 of the support pole 14, the slits 15*a-d* become progressively wider from the top of the slit 15*a-d* down to the base of the support pole 14. By flaring out the lower end 13, the lower end 13 has an increased cross-sectional area as compared to that of the basic support pole 10. In one exemplary embodiment, the expanded slits 15*a-d* extend along the length of the support pole 14, where the sides of the slits measure 6.2 inches and the bottom of the expanded slits 15*a-d* have width of 1.7 inches. Further, in one exemplary embodiment, the horizontal dimension of each side of the support pole 14 is approximately 6 inches and the horizontal dimension of lower end 13 is approximately 6.2 inches.

In an alternative embodiment, a mounting plate 32 can have a larger dimension with coupling apertures 36*a-d* being dimensioned farther apart from one another. The greater distance between coupling apertures 36*a-d* allows for the expansion of the support pole 14 to a dimension greater than 6.2 inches along the lower end 13. In addition, support poles 14 having a horizontal dimension of each non-expanded side can be greater than 6 inches when a mounting plate 32 that has dimensions and coupling aperture spacing greater than a standard mounting plate 32 is used.

An additional feature of the basic support pole 10 that is maintained throughout the below described modifications is the hand hole 34. The hand hole 34 allows access to the interior of the basic support pole 10. The hand hole 34 may allow an operator to have direct access to wiring leading from the top of the basic support pole 10 to another location, access to control functions, or other features know to those skilled in the art. In one exemplary embodiment, the hand hole 34 begins at twelve inches above the bottom of the basic support pole 10. The position of the hand holes can limit the height of the slit 15 to, for example, less then twelve inches and extend upwards thereof in one exemplary embodiment.

FIGS. 3*a* and 3*b* are a side elevation view of the reinforcing member according to one exemplary embodiment of the present invention. Referring now to FIGS. 2*b*, 3*a*, and 3*b*, the dimensions of the reinforcing member 20 are typically based on the dimensions of the slits 15*a-d* and the lower end 13 after the lower end 13 of the support pole 14 has been flared out. Flared portions 16*a*1-*d*2 of the lower end 13 of the support pole 14 provide the support structure for the reinforcing members 20 to attach to the support pole 14. The reinforcing members 20 cover the expanded slits 15*a-d* when coupled to the flared portions 16*a*1-*d*2 of the support pole 14. The reinforcing members 20 can have any geometric configuration. However, in one exemplary embodiment, the reinforcing members 20 have a substantially rectangular shape. In one exemplary embodiment, the reinforcing members 20 are made from a single piece of material, such as steel, and have a uniform thickness. In one exemplary embodiment, the thickness of the reinforcing member 20 is 0.120 inches. However, as set forth above, the thickness of both the pole 14 and the reinforcing member 20 can be greater or less based on the particular material used and the application for which the pole 14 is being designed.

Figure 4A:
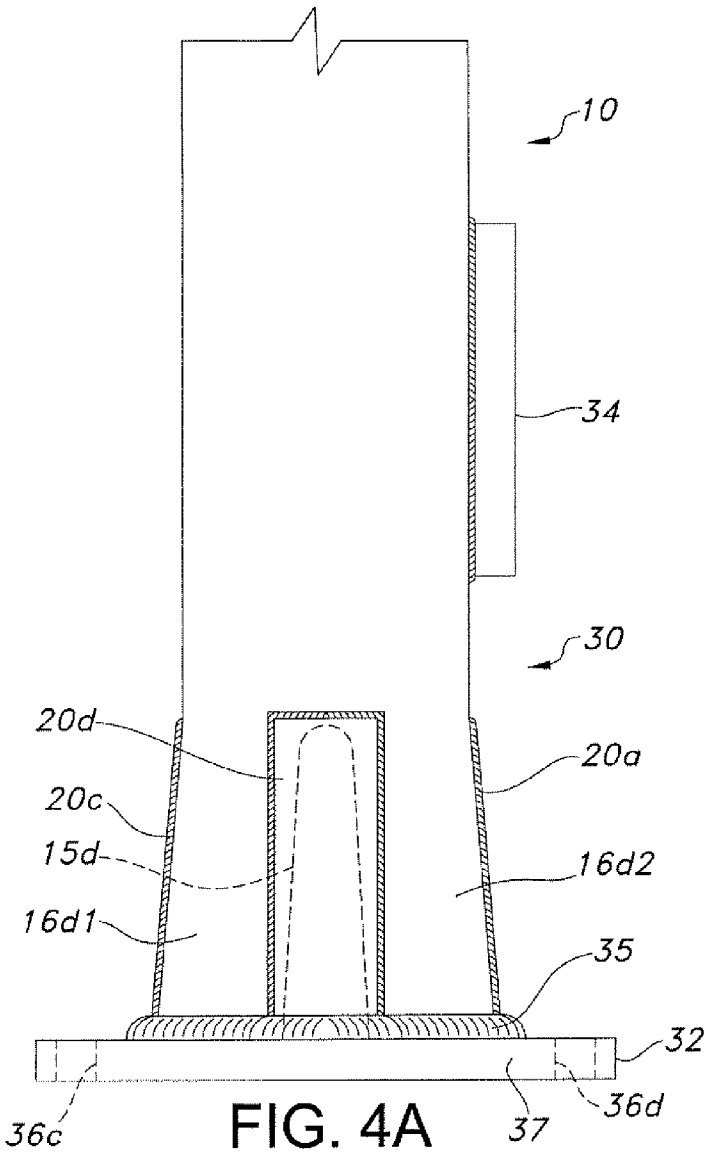
FIG. 4*a* is a partial elevation view of the reinforced support pole with the reinforcing members attached and the reinforced support pole coupled to a mounting plate according to one exemplary embodiment of the present invention.
Figure 4B:
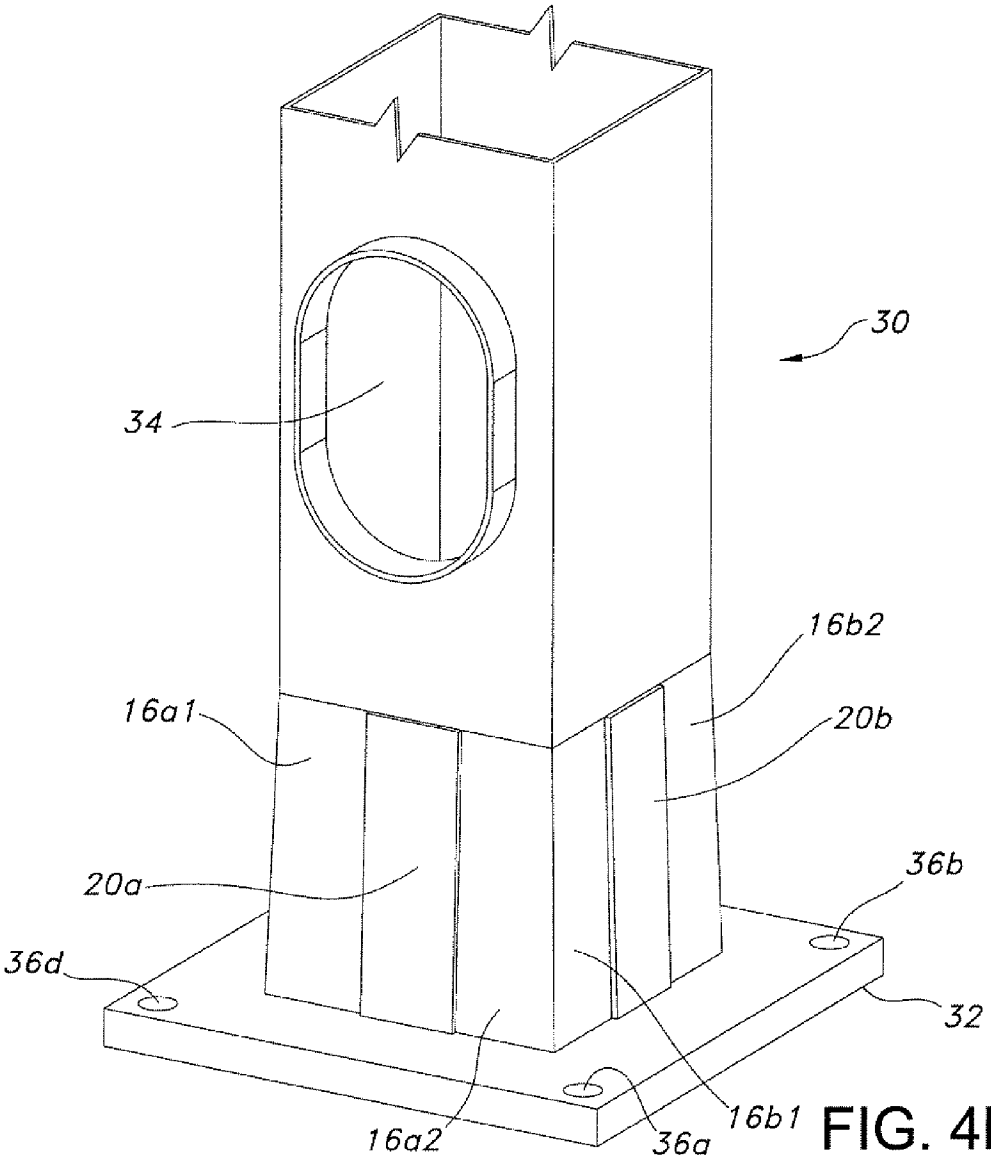
FIG. 4*b* is a perspective view of the reinforced support pole of FIG. 4*a* according to one exemplary embodiment of the present invention.

FIG. 4*a* is a partial elevation view of the reinforced support pole with the reinforcing members 20 attached and the reinforced support pole 30 coupled to a mounting plate 32 according to one exemplary embodiment of the present invention. FIG. 4*b* is a perspective view of the reinforced support pole 30 of FIG. 4*a*. Now referring to FIGS. 4*a* and 4*b*, the reinforcing members 20*a-d* are coupled to the reinforced support pole 30. As shown, reinforcing member 20*a* covers expanded slit 15*a* (not shown). Similar reinforcing members 20*b-d* cover expanded slits 15*b-d* (not shown). The reinforcing members 20*a-d* may then be attached to the flared portions 16*a*1-*d*2 of the support pole 14 by any means known to those skilled in the art. In one exemplary embodiment, each reinforcing member 20*a-d* is welded to the corresponding flared portions 16*a*1-*d*2 correspond to the expanded slit 15*a-d*. In the exemplary embodiment, reinforcing member 20*a* is coupled to flared portions 16*a*1-*a*2. Reinforcing member 20*a* is welded to one side of flared portion 16*a*1, while the other side of the reinforcing member 20*a* is welded to flared portion 16*a*2. In the exemplary embodiment, each face 12 of the reinforced support pole 30 has a reinforcing member 20 coupled to the reinforced support pole 30 which is substantially similar to the previously disclosed reinforcement member 20*a* attached to flared out portions 16*a*1-*a*2, with the reinforcing members designated 20*b-d* for the associated flared out portions 16*b*1-*d*2.

The reinforced support pole 30 is then coupled to a mounting plate 32 that conforms to known industry standards. In one exemplary embodiment, a standard mounting plate 32 is a 10.5 inch square plate with a thickness of approximately 0.75 inches. However, the mounting plate 32 can have greater or lesser length, width and depth dimensions. In alternative embodiments, the mounting plate 32 is a substantially square shape with eleven inch or twelve inch sides. Further, the thickness of the mounting plate 32 can be increased or decreased based on the particular use of the pole 14 and or specific installation factors with each use. In one exemplary embodiment, the mounting plate 32 is fixed by bolts to a surface, such as side walls, streets, raised base, or the like via coupling apertures 36*a*, 36*b*, 36*c* (not shown) and 36*d* (not shown). In one exemplary embodiment, the coupling apertures 36*a-d* are a slot having dimensions of 0.88 inches by 1.38 inches and the bolts are three-quarter inch bolts. However, coupling aperture dimensions and bolt sizes can be more or less based on the particular use of the pole 14 or the preferences of the installer and are within the scope of the present invention. The base 35 of the reinforced support pole 30, including the reinforcing members 20*a-d* and the flared portions 16*a*1-*d*2, is attached to the top surface 37 of the mounting plate 32. In one exemplary embodiment, the bottom of the flared portions 16*a*1-*d*2 and the reinforcing members 20*a-d* are welded to the top surface 37 of the base plate 32 with a weld having a weld radius of approximately 0.25 inches. In one exemplary embodiment, the minimum weld radius is 0.125 inches.

The cross-sectional area of the base 35 of the reinforced support pole 30 is greater than the cross-sectional area above the slits 15 where the reinforced pole 30 has not been expanded. The base 35 with flared portions 16*a*1-*d*2 is compatible with industry standard mounting plates 32 and does not interfere with the location of existing coupling apertures 36*a-d*, or the space needed to couple to the plate 32 with standard mounting bolts. In one exemplary embodiment, with the greater cross-sectional area of the flared portions 16*a*1-*d*2, the load of reinforced support pole 30 is distributed over a larger area.

Several alternative embodiments of the above disclosed invention are also possible. In one alternative embodiment, the reinforcing members 20 are coupled to the support pole 14 after the support pole 14 has been coupled with the mounting plate 32. In another alternative embodiment, the support pole 14 is coupled to the mounting plate 32, and then the reinforcing members 20*a-d* are coupled to the flared portions 16*a*1-*d*2 and over the expanded slits 15*a-d*. In each of the alternative embodiments, the overall structure is substantially similar to the previously disclosed reinforced support pole 30 coupled to a mounting plate 32.

Figure 5A:
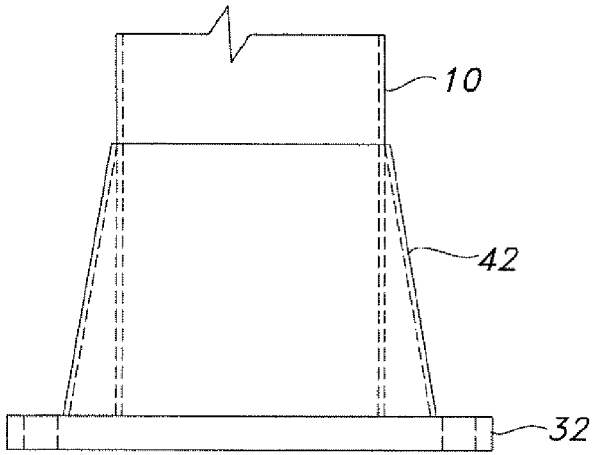
FIG. 5*a* is a partial elevation view of a basic support pole with a reinforcing device according to an alternative exemplary embodiment of the present invention.
Figure 5B:
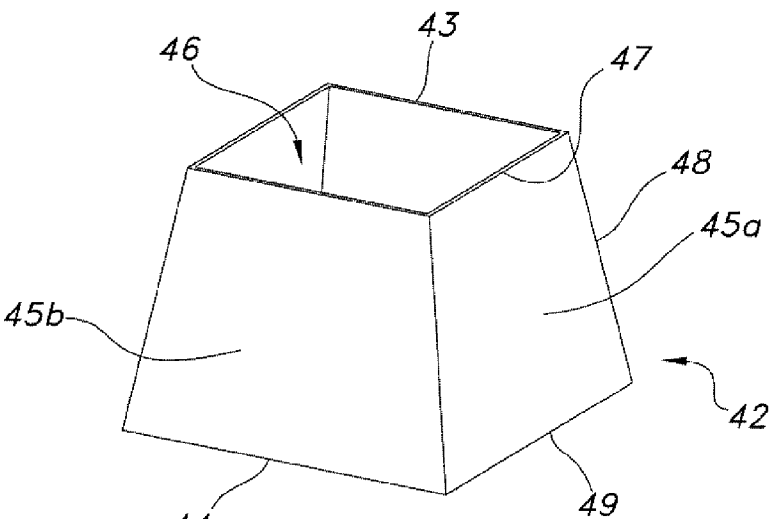
FIG. 5*b* is a perspective view of the reinforcing device of FIG. 5*a* according to one exemplary embodiment of the present invention.

Additional alternatives are within the scope of this invention. FIG. 5*a* is a partial elevation view of a basic support pole 10 with a reinforcing device 42 according to an alternative exemplary embodiment of the present invention. FIG. 5*b* is a perspective view of the reinforcing device 42 of FIG. 5*a* according to one exemplary embodiment of the present invention. Referring to FIGS. 5*a* and 5*b*, the reinforcing device 42 includes a top end 43 and a bottom end 44. The top end 43 has a smaller cross-sectional area than the bottom end 44. In some exemplary embodiments, the dimensions of the top end 43 are substantially equal to, but slightly larger than the horizontal dimensions of the basic support pole 10, so that the basic support pole 10 may be slidably inserted through the opening in the top end 43 of the reinforcing device 42. The bottom end 44 of the reinforcing device 42 has a dimension substantially similar to the dimension of the base 35 of the flared portion 16*a*1-*d*2 in FIG. 4*a-b*. In one exemplary embodiment, the reinforcing device 42 includes multiple members 45 extending from the top end 43 to the bottom end 44 to create a cavity or channel 46 for the basic support pole 10 to pass through. The members 45 have a top end 47, a bottom end 49, and side ends 48. The side end 48 of one member is typically coupled to the side end 48 of another member 45. In one exemplary embodiment, the dimensions of the top end 47 is less than the dimension of the bottom end 49. In this embodiment, each member 45 has a substantially trapezoidal shape. However, other geometric and irregular shapes can be sued for each member 45 within the scope of this invention. Further, in the embodiment, the resulting device is substantially in the shape of a frustum of a square pyramid. In one exemplary embodiment, both the basic support pole 10 and the reinforcing device 42 are coupled to the mounting plate 32 separately. In one exemplary embodiment, the reinforcing device 42 is coupled to the basic support pole 10 by welding and the reinforcing device 42 and the basic pole 10 are coupled to the mounting plate 32 by welding. A further alternative is to couple the basic support pole 10 to the mounting plate 32, and then couple the reinforcing device 42 to the mounting plate 32 and the basic support pole 10 by, for example, welding.

Figure 6:
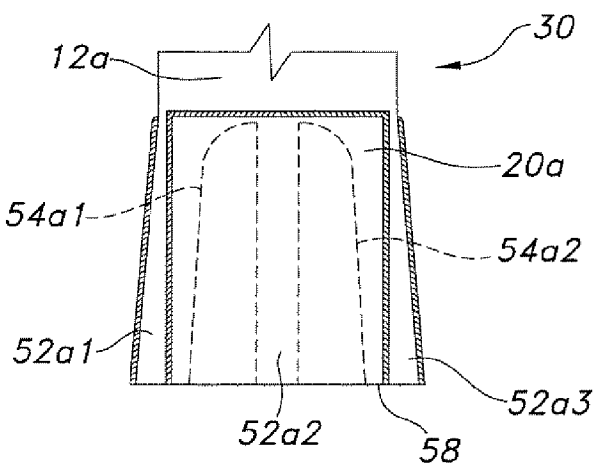
FIG. 6 is a partial elevation view of a reinforced support pole with a reinforcing member covering multiple slits on each side of the support pole according to an alternative exemplary embodiment of the present invention.

FIG. 6 is a partial elevation view of a reinforced support pole 30 with a reinforcing member 20 covering multiple slits 54*a*1-*d*2 on each face 12*a-d* of the reinforced support pole 30 according to an alternative exemplary embodiment of the present invention. Referring to FIG. 6, the alternative embodiment includes the same reinforcing members 20 or reinforcing device 42 previously disclosed with reference to FIGS. 4 and 5. In this alternative embodiment, the reinforced support pole 30 includes face 12*a*. The reinforced support pole 30 further includes multiple slits 54*a*1-*a*2 on face 12*a* along the lower end 13 of the reinforced support pole 30. In this exemplary embodiment, there are other faces 12*b-d* to the support pole 14 that would include multiple slits 54*b*1-*d*2 of a configuration substantially similar to that discussed for face 12*a* and multiple slits 54*a*1-*a*2. As previously discussed, once the slits 54*a*1-*a*2 have been cut into the support pole 14, the mandrel is placed in the lower end 13 and the lower end 13 is expanded outward to create the flared portions 52*a*1-*a*3. In this exemplary embodiment, the other faces 12*b-d* would also expand multiple slits 54*b*1-*d*2 by the same method to create flared portions 52*b*1-*d*3 that are substantially similar to that discussed for flared portions 52*a*1-*a*3. As with the previously disclosed embodiment, the base 58 of the flared portions 52*a*1-*a*3 has increased the cross-sectional area than the remaining portion of the reinforced support pole 30. The resulting multiple expanded slits 54*a*1-*a*2 for a single face 12*a* are then covered by a reinforcing member 20 or a reinforcing device 42 of FIG. 5*b*.

Figure 7:
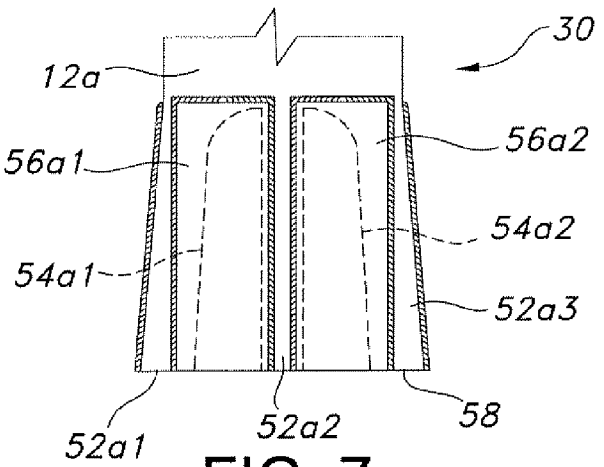
FIG. 7 is a partial elevation view of a reinforced support pole with multiple slits and a reinforcing member covering each slit according to another alternative exemplary embodiment of the present invention.

FIG. 7 is a partial elevation view of a reinforced support pole 30 with multiple slits 54*a*1-*a*2 and a reinforcing member 56*a*1-*a*2 covering each slit 54*a*1-*a*2 according to another alternative exemplary embodiment of the present invention. Referring to FIG. 7, as with the previously disclosed embodiment of FIG. 6, the embodiment of FIG. 7 includes a reinforcing member 56*a*1-*a*2 covering a separate expanded slit 54*a*1-*a*2. This alternative embodiment allows multiple reinforcing members 56*a*1-*a*2 to be used on the same face 12*a*, each covering a single expanded slit 54*a*1-*a*2. In this exemplary embodiment, the other faces 12*b-d* would also contain multiple slits 54*b*1-*d*2 and be covered by separate reinforcing members 56*b*1-*d*2 that are substantially similar to that discussed as reinforcing members 56*a*1-*a*2.

As described herein, the present invention is well adapted to attain the ends and advantages mentioned, as well as those inherent therein. The particular embodiments above are illustrative only, as the present invention may be modified and practiced in different but equivalent manners apparent to those having ordinary skill in the art having the benefit of the teachings provided herein. Having described some exemplary embodiments of the present invention, it is believes that the used of alternate inputs connectors or output connectors is within the purview of those having ordinary skill in the art.

While numerous changes may be made by those having ordinary skill in the art, such changes are encompassed within the spirit and scope of this invention as defined by the appended claims. Furthermore, no limitations are intended to the exemplary details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicit and clearly defined by the patentee.

What is claimed is:

1. A support pole, comprising:

an elongated pole member comprising an upper end, an opposing lower end comprising a bottom edge, and a plurality of sides extending along a longitudinal axis of the pole member;

at least one cut-out slit disposed on each of the plurality of sides, each slit extending up a predetermined length from the bottom edge of the pole member substantially towards the upper end, wherein each slit comprises a bottom end and a top end and wherein each side of the pole is angularly displaced outward away from the longitudinal axis of the pole member from a point substantially adjacent the top end of the slit to the lower end of pole member;

a plurality of reinforcing members each reinforcing member covering at least one slit on one of the plurality of sides, and each reinforcing member being permanently coupled to a respective side of the elongated pole member to prevent access to the respective at least one slit covered by the reinforcing member subsequent to the reinforcing member being coupled and a hand hole aperture disposed on one of the plurality of sides above one of the cut-out slits and between the upper end and the bottom edge, the hand hole aperture configured to provide access by a human hand to an interior of the support pole.

2. The support pole of claim 1, wherein a cross-sectional area of the pole member above the top end of the slit is less than a cross-sectional area of the pole member at the lower end.

3. The support pole of claim 1, wherein the predetermined length is less than seven inches.

4. The support pole of claim 1, wherein the predetermined length is between four and six inches.

5. The support pole from claim 1, wherein the reinforcing member comprises a rectangular shape.

6. The support pole of claim 1, further comprising a support pole mounting plate coupled to the lower end of the pole member.

7. The support pole from claim 6, wherein said support pole mounting plate comprises a plurality of apertures, each aperture configured to receive a coupling means for coupling the mounting plate to a surface.

8. The support pole of claim 1, wherein a portion of each side of the pole beginning adjacent the top end of the slit and extending to the bottom edge of the respective side is angularly displaced outward a greater amount than a remaining portion of each respective side of the support pole.

9. The support pole of claim 8, wherein a first cross-sectional area of the pole member immediately above the top end of the slit is less than a second cross-sectional area at the bottom edge of the pole member.

10. The support pole of claim 1, wherein each reinforcing member is welded to its respective side of the pole member and permanently covers it respective at least one slit.

11. A support pole, comprising:

an elongated pole member comprising an upper end, a lower end comprising a bottom edge, and a plurality of sides members extending along a longitudinal axis for the pole member between the upper and lower ends;

at least one slit provided in each of the plurality of side members, each slit extending upward from the bottom edge of the lower end of its respective side member;

wherein the slit comprises a bottom end and a top end;

wherein each side member of the pole is angularly displaced outward laterally away from the longitudinal axis a first amount from a point substantially adjacent the top end of the slit to the lower end bottom edge of each side member, wherein the angular displacement adjacent the top end of the slit provides a first cross-sectional area for the pole member at the bottom edge that is greater than a second cross-sectional area for the pole member above the top end of the slit; and a plurality of reinforcing members, each reinforcing member covering at least one slit and coupled to one of the sides of the elongated pole member.

12. The support pole of claim 11, wherein a first rate of angular displacement laterally out away from the longitudinal axis of the support pole is greater than a second rate of angular displacement laterally out away form the longitudinal axis of the support pole for a remaining portion of each respective side member.

13. A support pole, comprising:

an elongated pole member comprising an upper end, a lower end comprising a bottom edge, and a plurality of side members extending along a longitudinal axis for the pole member, at least one slit provided in a plurality of the side members, each slit extending from a bottom edge of its respective side member upward a predetermined length substantially towards the upper end;

wherein the slit comprises a bottom end and a top end; and wherein each side member is angularly displaced laterally away from the longitudinal axis at a first rate from an area substantially adjacent to the top end of each slit to the bottom edge of each side member and angularly displaced laterally away from the longitudinal axis at a second rate from an area below the upper end of the pole member down to the area substantially adjacent to the top end of each slit, and wherein the first rate of angular displacement is greater than the second rate of angular displacement.

14. The support pole of claim 13 further comprising a at least one reinforcing member covering the slit and coupled permanently coupled to one of the sides of the elongated pole to prevent subsequent access to the respective slit.

15. The support pole of claim 13, wherein a cross-sectional area of the pole member above the top end of the slit is less than a cross-sectional area of the pole member at the bottom edge.

16. The support pole of claim 13, further comprising at least one reinforcing member, each reinforcing member welded to one of the plurality of side members and covering the at least one slit in the respective side member.

* * * * *